US012624458B2

(12) United States Patent
Gois De Medeiros

(10) Patent No.: US 12,624,458 B2
(45) Date of Patent: May 12, 2026

(54) GRAVITY-CONTACT SACRIFICIAL ANODE

(71) Applicant: Petróleo Brasileiro S.A.—Petrobras, Rio de Janeiro (BR)

(72) Inventor: Edson Gois De Medeiros, Rio de Janeiro (BR)

(73) Assignee: Petróleo Brasileiro S.A.—Petrobras, Rio de Janeiro (BR)

( * ) Notice: Subject to any disclaimer, the term of this patent is extended or adjusted under 35 U.S.C. 154(b) by 840 days.

(21) Appl. No.: 17/917,656

(22) PCT Filed: Mar. 23, 2021

(86) PCT No.: PCT/BR2021/050120
§ 371 (c)(1),
(2) Date: Feb. 13, 2023

(87) PCT Pub. No.: WO2021/203184
PCT Pub. Date: Oct. 14, 2021

(65) Prior Publication Data

US 2024/0287684 A1 Aug. 29, 2024

(30) Foreign Application Priority Data

Apr. 9, 2020 (BR) ..... 10 2020 007168 8

(51) Int. Cl.
*C23F 13/20* (2006.01)
*C23F 13/18* (2006.01)

(52) U.S. Cl.
CPC ..... *C23F 13/20* (2013.01); *C23F 13/18* (2013.01)

(58) Field of Classification Search
CPC ..... C23F 13/02–13/22
See application file for complete search history.

(56) References Cited

U.S. PATENT DOCUMENTS 4,089,767 A 5/1978 Sabins
4,176,033 A * 11/1979 Council ..... C23F 13/02 204/196.18

(Continued)

FOREIGN PATENT DOCUMENTS

BR 9400848-5 A2 11/1994
BR 20201609529 U2 7/2017

(Continued)

OTHER PUBLICATIONS

International Preliminary Report on Patentability received for PCT Application No. PCT/BR2021/050120, mailed on Apr. 13, 2022, 13 Pages.

(Continued)

*Primary Examiner* — Alexander W Keeling
(74) *Attorney, Agent, or Firm* — Morrison & Foerster LLP

(57) ABSTRACT

The invention consists of a new sacrificial anode design that eliminates welding and reduces fixing time. This new anode design comprises a metallic appendix, which can be in the form of a hook, in order to hold and provide electrical contact between the anode and the jacket, or other part of the structure that is desired to be protected. In the contact region of the hook there will be a pointed device (3) to allow full electrical contact between the anode and the jacket element. Therefore, this electrical contact will be made by the anode's own weight, which may be added with a galvanically inert ballast to guarantee the contact until the end of the anode's lifetime.

6 Claims, 2 Drawing Sheets

(56) References Cited

U.S. PATENT DOCUMENTS

| | | | | |
|---|---|---|---|---|
| 5,176,807 | A * | 1/1993 | Kumar | F24H 9/455 204/290.13 |
| 5,932,087 | A * | 8/1999 | Terrase | C23F 13/16 204/288.2 |
| 2017/0191344 | A1* | 7/2017 | Shreffler, III | E21B 33/13 |
| 2018/0230604 | A1* | 8/2018 | Al-Kandari | E02B 17/0026 |

FOREIGN PATENT DOCUMENTS

| | | | |
|---|---|---|---|
| CN | 203159715 | U | 8/2013 |
| CN | 206127426 | U | 4/2017 |
| CN | 207392179 | U | 5/2018 |
| ES | 444138 | A1 | 5/1977 |

OTHER PUBLICATIONS

International Search Report and Written Opinion received for PCT Application No. PCT/BR2021/050120, mailed on May 25, 2021, 12 Pages.

Medeiros et al. (May 14-18, 2012) "Revitalização de Sistemas de Proteção Catodica em Unidades Maritimas Semissubmersíveis", INTERCORR, 1-26 Pages.

* cited by examiner

GRAVITY-CONTACT SACRIFICIAL ANODE

CROSS-REFERENCE TO RELATED APPLICATIONS

This application is a national phase application, filed under 35 U.S.C. § 371, of PCT International Patent Application No. PCT/BR2021/050120, filed Mar. 23, 2021, and claims benefit of and priority to Brazilian application BR 10 2020 007168 8, filed on Apr. 9, 2020, the disclosures of all of which are incorporated herein by reference in their entirety.

FIELD OF INVENTION

Application in any submerged metallic structure subjected to an oxidizing environment that allows "hanging" the gravity-contact sacrificial anode, in particular the jackets of fixed production platforms.

DESCRIPTION OF THE STATE OF THE ART

Cathodic protection is one of the most used methods for the protection of large structures whether buried or submerged (partially or totally). Thus, pipelines and storage tanks for gas and various fuels, oil platforms, ships, piers and even reinforced concrete buildings are more and more protected by this method.

Cathodic protection by sacrificial anodes is a technique used to protect a material from electrochemical etching (corrosion). This protection is based on the fact that there is a metal that has a lower corrosion potential and, as such, is corroded during the reaction, that is, it takes the corrosion potential of the equipment to be protected to values corresponding to the immunity of the material. The use of sacrificial anodes was developed so that they are corroded (dissolved) in place of the material to be protected from corrosion.

Several platforms, most of them with jackets, use sacrificial anodes for the anticorrosive protection of their submerged part. The replacement of these anodes requires expensive services that use divers for submerged welding work, which impacts the budget, especially in those with low oil and gas production levels.

The replacement of sacrificial anodes, necessary especially in units that are approaching the end of their project life, is done conventionally with the fixation by welding to the submerged part of the platform structure. On protected platforms, the quantities of these anodes vary from a few tens to several hundred units, depending on the size of the structure (water sheet). The number of welding points is doubled since each anode requires two welding points, one at each end.

The document BR202016029529U2 reveals a quick coupling system with lock intended for sacrificial anode. It is an easier, faster, more efficient and dynamic way, which is done manually by the person in charge in carrying out the assembly of the anodes. The document adapts a conventional anode to its fixation mode, different from what the invention proposes, since the invention refers to an anode that has a shape designed for a single assembly.

The document ES444138A1 discloses an apparatus for cathodic protection of the sacrificial anode type that is easy to install and easy to replace compared to the usual types. It is used in ballast deposits on vessels and comprises a plurality of anodes interconnected with each other through cables and quick coupling, forming a protection line with several sacrificial elements. The document teaches a cathodic protection in the form of a line with quick couplings, different from the proposal of the present invention.

The document U.S. Pat. No. 4,089,767A discloses a cathodic protection system for metallic structures arranged in contact with sea water, includes a plurality of sacrificial anodes mechanically connected in a suspended chain. The anode chain is electrically coupled to the structure, and the means are provided to selectively release and retrieve the chain from storage to increase or decrease the length of the chain immersed in water. The document's cathodic protection in the form of electric current is a very different way from the configuration proposed by the invention.

The document PI9400848-5A discloses a sacrificial anode for the corrosion protection of offshore structures. It consists of a composite structure in which a first anodic material, which constitutes an external coating on the same anode carrier device, with said material having a more negative electrochemical potential than the material that constitutes the offshore structure to be protected, is provided in turn with an external coating consisting of a second anodic material, which electrochemical potential is even more negative than that of said first material. It is a conventional anode, with its installation and replacement made exactly in the way that the present invention proposes to modify.

The state of the art mentioned above does not have the unique characteristics that will be presented in detail below. This invention aims to substantially lower this cost by presenting a new installation embodiment where submerged welding services are eliminated and the diving service time is substantially reduced.

BRIEF DESCRIPTION OF THE INVENTION

The invention consists of a new sacrificial anode design that eliminates welding and reduces fixing time. This new anode design comprises a metallic appendix, which can be in the form of a hook, in order to hold and provide electrical contact between the anode and the jacket, or other part of the structure that is desired to be protected.

In the contact region of the hook there will be a pointed device (3) to allow full electrical contact between the anode and the jacket element. Therefore, this electrical contact will be made by the anode's own weight, which may be added with a galvanically inert ballast to guarantee the contact until the end of the anode's lifetime.

BRIEF DESCRIPTION OF THE DRAWINGS

The present invention will be described in more detail below, with reference to the attached figures which, in a schematic and not limiting of the inventive scope, represent examples of its realization. In the drawings, there are.

DETAILED DESCRIPTION OF THE INVENTION

Figure 1:
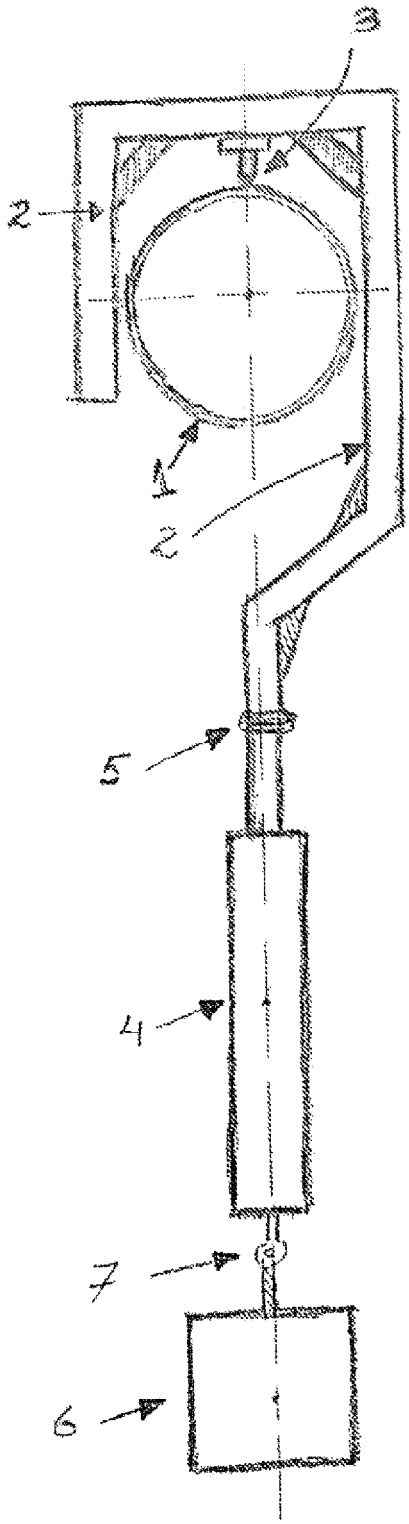
FIG. 1 illustrates the gravity-contact sacrificial anode.
Figure 2:
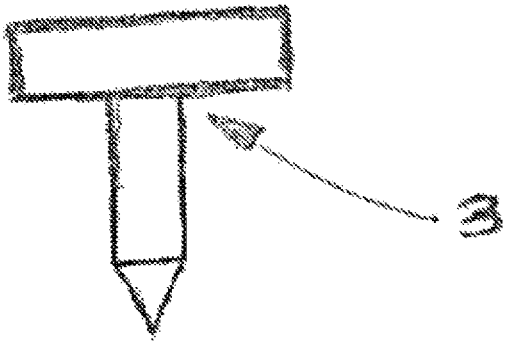
FIG. 2 illustrates the electrical contact pin.

The gravity-contact sacrificial anode has the following components:

Accessory for anchoring and electrical contact (2);
Electrical contact pin (3);
Sacrificial anode (4);
Hook weld (5);
Ballast (6);
Eyebolt (7).

The accessory for anchoring and electrical contact (2) serves to mount the anode on the structure (1) to be protected, wherein it has a predominantly hook shape precisely for better accommodation and ease of assembly on the structure support element (1). At one of its ends, the accessory (2) has an electrical contact pin (3) that is responsible for allowing full electrical contact between the anode (4) and the structure supporting element (1).

The accessory (2) is joined to the anode core (4) by hook weld (5), as shown in FIG. 1.

At the lower end of the anode (4) there is an eyebolt (7) for the optional attachment of a galvanically inert ballast (6) to ensure contact until the end of the anode lifetime (4). With the anode mass consumption over time, the anode loses weight and its electrical contact with the structure can be compromised, a problem that is eliminated by previously adding an appropriately sized ballast to ensure this electrical contact until the end of the anode lifetime.

The electrical contact is ensured by the gravitational force exerted on the sacrificial anode assembly, it causes the pointed tip of the contact pin (3) to always be in solid metallic contact with the structure supporting element (1).

The invention claimed is:

1. A gravity-contact sacrificial anode comprising:

an accessory for anchoring and electrically contacting a sacrificial anode to a structure supporting element;

an electrical contact pin providing electrical contact between the sacrificial anode and the structure supporting element due at least to the sacrificial anode's own weight;

a hook weld;

an eyebolt; and a ballast fixed to the eyebolt on a side of the sacrificial anode opposite the hook weld.

2. The gravity-contact sacrificial anode of claim 1, wherein the accessory for anchoring and electrical contact has a hook shape.

3. The gravity-contact sacrificial anode of claim 1, wherein the electrical contact pin has a pointed shape that ensures a solid electrical contact between the sacrificial anode and the structure supporting element.

4. The gravity-contact sacrificial anode of claim 1, wherein the hook weld joins the accessory for anchoring and electrical contact and the sacrificial anode.

5. The gravity-contact sacrificial anode of claim 3, wherein gravitational force ensures electrical contact between the electrical contact pin and the structure supporting element.

6. The gravity-contact sacrificial anode of claim 1, wherein the electrical contact pin provides electrical contact between the sacrificial anode and a topside of the structure supporting element.

* * * * *